US007760886B2

(12) United States Patent
Hellmuth et al.

(10) Patent No.: US 7,760,886 B2
(45) Date of Patent: Jul. 20, 2010

(54) APPARATUS AND METHOD FOR SYNTHESIZING THREE OUTPUT CHANNELS USING TWO INPUT CHANNELS

(75) Inventors: Oliver Hellmuth, Erlangen (DE); Jürgen Herre, Buckenhof (DE); Harald Popp, Tuchenbach (DE); Andreas Walther, Bamberg (DE)

(73) Assignee: Fraunhofer-Gesellschaft zur Foerderung der Angewandten Forscheng e.V., Munich (DE)

( * ) Notice: Subject to any disclaimer, the term of this patent is extended or adjusted under 35 U.S.C. 154(b) by 1155 days.

(21) Appl. No.: 11/313,180

(22) Filed: Dec. 20, 2005

(65) Prior Publication Data

US 2007/0140500 A1 Jun. 21, 2007

(51) Int. Cl.
*H04R 5/00* (2006.01)

(52) U.S. Cl. ..... 381/27; 381/17; 381/18; 381/106

(58) Field of Classification Search ..... 381/1, 381/17–18, 27, 104, 106
See application file for complete search history.

(56) References Cited

U.S. PATENT DOCUMENTS

| | | | | |
|---|---|---|---|---|
| 5,136,650 | A * | 8/1992 | Griesinger | 381/22 |
| 5,706,309 | A | 1/1998 | Eberlein et al. | |
| 6,198,826 | B1 | 3/2001 | Cowieson et al. | |
| 6,240,189 | B1 * | 5/2001 | Aylward | 381/18 |
| 6,496,584 | B2 | 12/2002 | Irwan et al. | |
| 6,697,491 | B1 | 2/2004 | Griesinger | |
| 6,920,223 | B1 | 7/2005 | Fosgate | |
| 2004/0037440 | A1 | 2/2004 | Croft, III | |
| 2004/0140915 | A1 | 7/2004 | Shen et al. | |
| 2008/0170711 | A1 | 7/2008 | Breebaart et al. | |

FOREIGN PATENT DOCUMENTS

| | | | |
|---|---|---|---|
| CN | 1636421 | A | 7/2005 |
| EP | 1881486 | A1 | 1/2008 |

(Continued)

OTHER PUBLICATIONS

Jot et al.: "Spatial Enhancement of Audio Recordings", AES 23rd International Conference, Copenhagen, Denmark, May 23-25, 2003, pp. 1-11, XP002401944.

(Continued)

*Primary Examiner*—Xu Mei
*Assistant Examiner*—Disler Paul
(74) *Attorney, Agent, or Firm*—Laurence A. Greenberg; Werner H. Stemer; Ralph E. Locher

(57) ABSTRACT

For synthesizing at least three output channels using two stereo input channels, the stereo input channels are analyzed to detect signal components occurring in both input channels. A signal generator is operative to introduce at least a part of the detected signal components into the second channel associated with a second speaker in an intended speaker scheme, which is positioned between a first and a third speaker in the speaker scheme. When, however, feeding of the complete detected signal components would result in a clipping situation, then only a part of the detected signal components is fed into the second channel as a real center channel and the remainder is located in the first and third channels as a phantom center channel.

19 Claims, 5 Drawing Sheets

FOREIGN PATENT DOCUMENTS

| | | | |
|---|---|---|---|
| JP | 11331998 | A | 11/1999 |
| JP | 2000059896 | A | 2/2000 |
| JP | 2005223935 | A | 8/2005 |
| RU | 2129336 | C1 | 4/1999 |
| TW | 510143 | B | 11/2002 |
| TW | 533746 | B | 5/2003 |
| WO | 0004744 | A1 | 1/2000 |

OTHER PUBLICATIONS

Griesinger: "Multichannel Matrix Surround Decoder for Two-Eared Listeners", Waltham, MA, pp. 1-21.

Jot, et al.: "Spatial Enhancement of Audio Recordings", AES 23rd International Conference, Copenhagen, Denmark, May 23-25, 2003, pp. 1-11.

Dolby Publication: "Dolby Surround Pro Logic II Decoder—Principles of Operation", http://www.dolby.com/assets/pdf/tech_library/209_Dolby_Surround_Pro_Logic_II_Decoder_Principles_of_Operation, 8 pgs.

Russian Decision on Grant issued on Oct. 7, 2009.

* cited by examiner

APPARATUS AND METHOD FOR SYNTHESIZING THREE OUTPUT CHANNELS USING TWO INPUT CHANNELS

FIELD OF THE INVENTION

The present invention is related to multi-channel synthesizers and, particularly, to devices generating three or more output channels using two stereo input channels.

BACKGROUND OF THE INVENTION AND PRIOR ART

Multi-channel audio material is becoming more and more popular also in the consumer home environment. This is mainly due to the fact that movies on DVD offer 5.1 multi-channel sound and therefore even home users frequently install audio playback systems, which are capable of reproducing multi-channel audio. Such a setup consists e.g. of 3 speakers L, C, R in the front, 2 speakers Ls, Rs in the back and a low frequency enhancement channel LFE and provides several well-known advantages over 2-channel stereo reproduction, e.g.:

- improved front image stability even outside of the optimal central listening position due to the Center channel (larger "sweet-spot"=optimum listening position)
- increased sense of listener "involvement" created by the rear speakers.

Nevertheless, there exists a huge amount of legacy audio content, which consists only of two ("stereo") audio channels, e.g. on Compact Discs (CDs).

To play back two-channel legacy audio material over a 5.1 multi-channel setup there are two basic options:

1. Reproduce the left and right channel stereo signals over the L and R speakers, respectively, i.e., play it back in the legacy way. This solution does not take advantage of the extended loudspeaker setup (Center and rear loudspeakers).
2. One may use a method to convert the two channels of the content material to a multi-channel signal (this may happen "on the fly" or by means of preprocessing) that makes use of all the 5.1 speakers and in this way benefits from the previously discussed advantages of the multi-channel setup.

Solution #2 clearly has advantages over #1, but also contains some problems especially with respect to the conversion of the two front channels (Left and Right=LR) to three front channels (Multi-channel Left, Center and Right=L'C'R').

A good LR to L'C'R' conversion solution should fulfill the following requirements:

1) To recreate a similar, but more stable front image in the L'C'R' than in the LR playback case, The Center channel shall reproduce all the sound events which usually are perceived to come from the middle between the Left and Right loudspeaker, if the listener is in the "sweet spot". Furthermore, signals in left front positions shall be reproduced by L'C', and signals in the right front positions shall be reproduced by R'C', respectively (see J. M. Jot and C. Avendano, "Spatial Enhancement of Audio Recordings", AES 23rd Conference, Copenhagen, 2003).
2) The sum of the acoustical energy emitted by the channels L'C'R' should be equal to the sum of the acoustical energy of the source channels LR in order to achieve an equally loud sound impression for L'C'R as for LR. Assuming equal characteristics in all reproduction channels, this translates into "the sum of the electrical energy of the channels L'C'R' should be equal to the sum of the electrical energy of the source channels LR."

Due to requirement #1 the signals of the Left and Right channels may be mixed into one (single) center channel. This is particularly true, if the Left and the Right channel signals are near identical, i.e. they represent a phantom sound source in the middle of the front sound stage. This phantom image is now replaced by a "real" image generated by the Center speaker. Due to requirement #2, this Center signal shall carry the sum of the Left and the Right energy. If the level of the Left or the Right channel signals is close to the maximum amplitude that can be transmitted by the channel (=0 dBFS; dBFS=dB Full Scale), the sum of the levels of both channels will exceed the maximum level, which can be represented by the channel/system. This usually results in the undesirable effect of "clipping".

The clipping situation is shown in FIG. 6. FIG. 6 illustrates a time waveform of a signal 60 processed by a processor having a maximum positive threshold 61*a* and a maximum negative threshold 61*b*. Depending on the capability of the digital processor processing the digital signal, the maximum positive threshold and the maximum negative thresholds may be +1 and −1. Alternatively, when a digital processor is used representing the numbers in integers, the maximum positive threshold will be 32768 corresponding to $2^{15}$, and the maximum negative threshold will be −32768 corresponding to $-2^{15}$.

Since a time waveform signal is represented by a sequence of samples, each sample being a digital number between −32768 and +32768, it is easily clear that higher numbers can be obtained, when, for a certain time instance, the first channel has a quite high value and the second channel also has a quite high value, and when these quite high values are added together. Theoretically, the maximum number obtained by this adding together of two channels can be 65536. However, the digital signal processor is not able to represent this high number. Instead, the digital processor will only represent numbers equal to the maximum positive threshold or the maximum negative threshold. Therefore, the digital signal processor performs clipping in that a number higher or equal to the maximum positive threshold or the maximum negative threshold is replaced by a number equal to the maximum positive threshold and the maximum negative threshold so that, with regard to FIG. 6, the illustrated situation appears. Within a clipping time portion 62, the waveform 60 does not have its natural (sine) shape, but is flattened or clipped. When this clipped waveform is evaluated from a spectral point of view, it becomes clear that this time domain clipping results in strong harmonic components caused by a high gradient magnitude at the beginning and the end of the clipping time portion 62.

This "digital clipping" is not related to the replay setup, i.e., the amplifier and the loudspeakers used for rendering the audio signal. However, each amplifier/loudspeaker combination also has only a limited linear range, and, when this linear range is exceeded by a processed signal, also a kind of clipping takes place, which can be avoided using the inventive concept.

In any case, the occurrence of clipping introduces heavy distortions in the audio signal, which degrade the perceived sound quality very much. Thus, the occurrence of clipping has to be avoided. This is even more due to the fact that the sound improvement by rendering a stereo signal by a multi-channel setup such as a 5.1 speaker system is small compared to the very annoying clipping distortions. Therefore, when one cannot guaranty that clipping does not occur, one would prefer to only use the left and the right speakers of a multi-channel setup for rendering a stereo signal.

There exist prior art solutions to overcome this clipping problem.

A simple solution to overcome this problem is to scale down all channels equally to a level where none of the channel signal (especially the Center signal) exceeds the 0 dBFS limit. This can be done statically by a predefined fixed value. In this case the fixed value must also be valid for worst case situations, where the Left and Right channel have maximum levels. For the average LR to L'C'R' conversion this leads to a significantly quieter L'C'R' version than the original stereo LR, which is undesirable, especially when users are switching between stereo and multi-channel reproduction. This behavior can be observed at commercially available matrix decoders (Dolby ProLogicII and Logic7 Decoder) that can be used as LR to L'C'R' converters. See Dolby Publication: "Dolby Surround Pro Logic II Decoder—Principles of Operation", http://www.dolby.com/assets/pdf/tech_library/209_Dolby_Surround_Pro_Logic_II_Decoder_Principles_of_Operation.pdf or Griesinger, D.: "Multichannel Matrix Surround Decoders for Two-Eared Listeners", 101st AES Convention, Los Angeles, USA, 1996, Preprint 4402.

Another simple solution is to use dynamic range compression in order to dynamically (depending on the signal) limit the peak signal, sometimes also called a "limiter". A disadvantage of this approach is that the true dynamic range of the audio program is not reproduced but subjected to compression (see Digital Audio Effects DAFX; Udo Zölzer, Editor; 2002; Wiley & Sons; p. 99ff: "Limiter").

The downscaling problem is undesirable, since it reduces the level or volume of a sound signal compared to the level of the original signal. In order to completely avoid any even theoretical occurrence of clipping, one would have to downscale all channels by a scaling factor equal to 0.5. This results in a strongly reduced output level of the multi-channel signal compared to the original signal. When one only listens to this downscaled multi-channel signal, one can compensate for this level reduction by increasing the amplification of the sound amplifier. However, when one switches between several sources, the (legacy) stereo signal will appear to a listener very loud, when it is replayed using the same amplification setting of the amplifier a set for the multichannel reproduction.

Thus, a user would have to think about reducing the amplification setting of its amplifier before switching from a multi-channel representation of a stereo signal to a true stereo representation of the stereo signal in order to not damage her or his ears or equipment.

The other prior art method using dynamic range compression effectively avoids clipping. However, the audio signal itself is changed. Thus, the dynamic compression leads to a non-authentic audio signal, which, even when the introduced artifacts are not too annoying, is questionable from the authenticity point of view.

SUMMARY OF THE INVENTION

It is an object of the present invention to provide an improved concept for multi-channel synthesis using two input channels.

This object is achieved by an apparatus for synthesizing three output channels using two input channels, wherein a second channel of the three output channels is feedable to a speaker in an intended audio rendering scheme, which is positioned between two speakers being feedable with the first output channel and the third output channel, comprising: an analyzer for analyzing the two input channels for detecting signal components occurring in both input channels; and a signal generator for generating the three output channels using the two input channels, wherein the signal generator is operative to feed detected signal components at least partly into the second channel, and to only feed a part of the detected signal components into the second channel, when a complete feeding of the detected signal components would result in exceeding a maximum threshold for the second channel.

In accordance with a further aspect of the present invention, this object is also achieved by a method of synthesizing three output channels using two input channels, wherein a second channel of the three output channels is feedable to a speaker in an intended audio rendering scheme, which is positioned between two speakers being feedable with the first output channel and the third output channel, comprising: analyzing the two input channels for detecting signal components occurring in both input channels; and generating the three output channels using the two input channels, wherein the step of generating is operative to feed detected signal components at least partly into the second channel, and to only feed a part of the detected signal components into the second channel, when a complete feeding of the detected signal components would result in exceeding a maximum threshold for the second channel.

In accordance with further aspects of the present invention, this object is achieved by a computer program implementing the inventive method and a three channel representation of the two channel input signal, which may or may not be stored on a computer-readable medium in a digital format for later replay or for transmission via a transmission medium. Alternatively, the channel representation can also be an analogue signal output by the digital/analogue converter or output by a speaker system having three or more speakers.

The present invention is based on the finding that, for overcoming the clipping problem and for nevertheless achieving the advantages incurred by replaying a stereo signal using three or more channels of a multi-channel setup, the center channel is generated as usual, i.e., receives sound events located in the middle between the left and the right loudspeakers, which is also called a "real center" rendering. However, when the real center would come into the clipping range, only a portion of the energy of the signal components representing the events in the middle of the audio setup are fed into the center channel. The remainder of the energy of these sound events is fed back into the first and third (or left and right) channels or remains there from the beginning.

Thus, for a time frame, where clipping may occur, when the two/three upmix procedure is performed without modifications, the center channel is scaled down the level below or equal to the maximum level possible without clipping. Nevertheless, the missing part/energy of the signal, which cannot be rendered by the center channel is reproduced with the left channel and the right channel as a "virtual center" or "phantom center".

The signal of the real center and the virtual center is then acoustically combined during playback recreating an intended center without clipping. This "mixing" of the real center and the virtual center results in an improved more stable front image of a stereo audio signal, i.e., in an increased sweet spot, although the sweet spot is not as large as when there would not be a phantom center at all. However, the inventive process does not have any clipping artifacts, since the remainder of the energy not being processable within the second channel due to the clipping problem is not lost but is rendered by the original left and right channels.

It is noted here that, for any situations, the energy of the left and right channels in the multi-channel setup is lower than the energy in the original left and right channels, since the energy of the center channel is drawn from the left and right channels. Therefore, even when, in accordance with the present invention, a remaining part of the energy is fed back to the left and right output channels, there will never exist a clipping problem within these channels.

A further advantage of the present invention is that the inventive signal generation is performed in a way that, in a preferred embodiment, the total electrical or acoustical energy of the generated three output channels (and optionally generated additional output channels such as Ls, Rs, Cs, LFE, . . . ) is preserved with respect to the energy of the original stereo signal. The same overall loudness irrespective of the way of rendering the signal, i.e., whether the signal is rendered using a stereo setup having only two speakers or whether the signal is rendered using a multi-channel setup having more than two speakers, can be guaranteed.

Furthermore, the inventive signal generation and distribution of sound energy to the center channel and the left and right channels is dynamically applied only if clipping would be unavoidable, i.e., the second center channel is completely unchanged in situations, which are not effected by clipping, i.e., when sampling values of the second channel remain below or are only equal to the maximum threshold.

Furthermore, the resulting acoustic combination of the "real center" and the "phantom center" produces a signal which is much closer to the optimal three channel configuration, i.e., three channels without clipping or three channels in which sampling values without any min/max threshold are allowable. The inventive sound image is, therefore, in preferred embodiments neither different in level compared to the stereo input signal nor non-authentic as would be the case when using a limiter or a simple clipper.

BRIEF DESCRIPTION OF THE DRAWINGS

Preferred embodiments of the present invention are subsequently explained with respect to the accompanying drawings, in which.

DETAILED DESCRIPTION OF PREFERRED EMBODIMENTS

Figure 1:
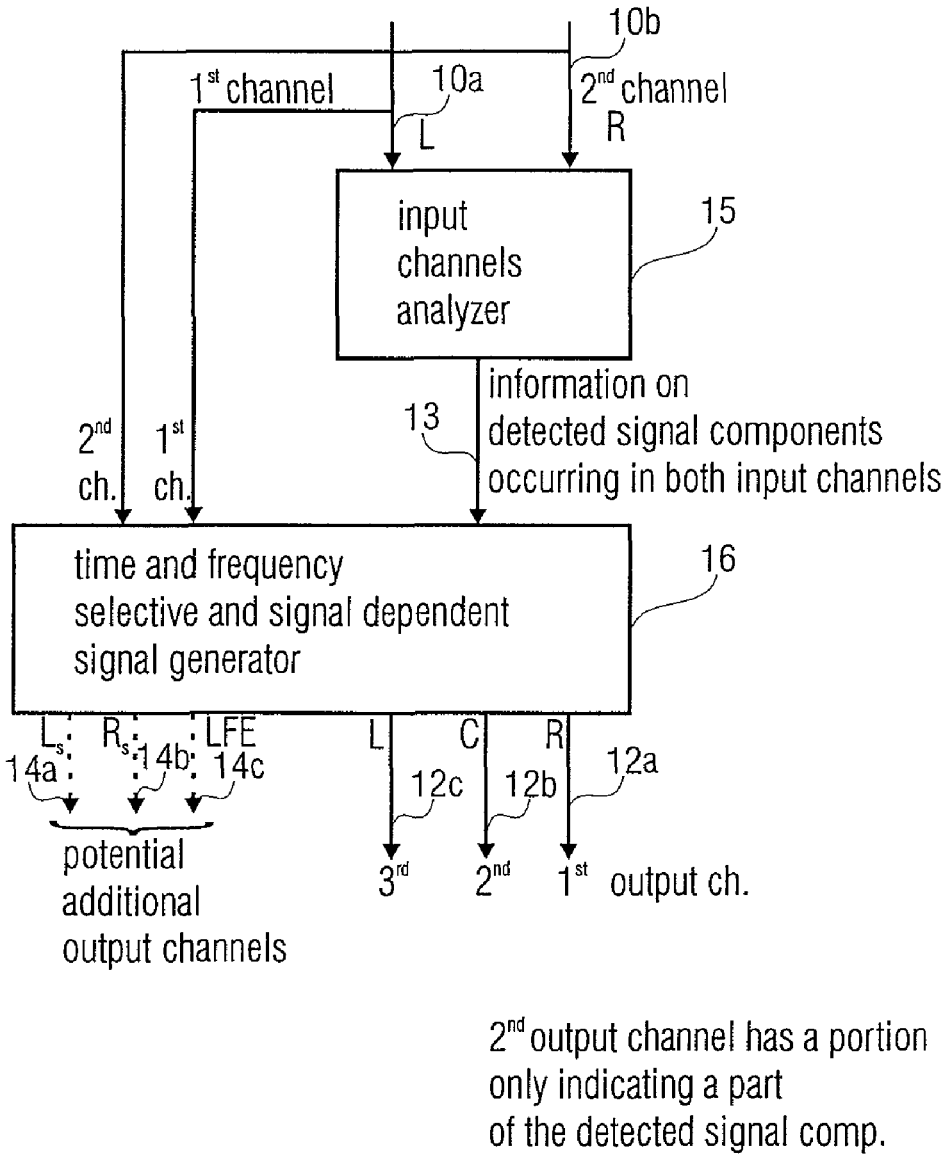
FIG. 1 illustrates an apparatus for synthesizing the upper channels in accordance with the preferred embodiment of the present invention.
Figure 5:
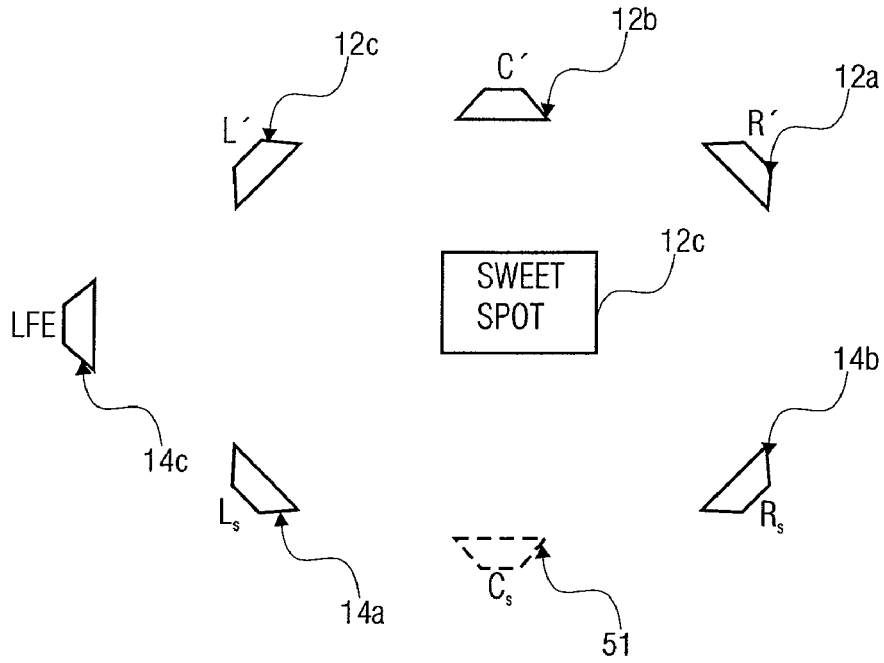
FIG. 5 an example for a 5.1 sound system optionally also having a surround center channel $C_s$.
Figure 6:
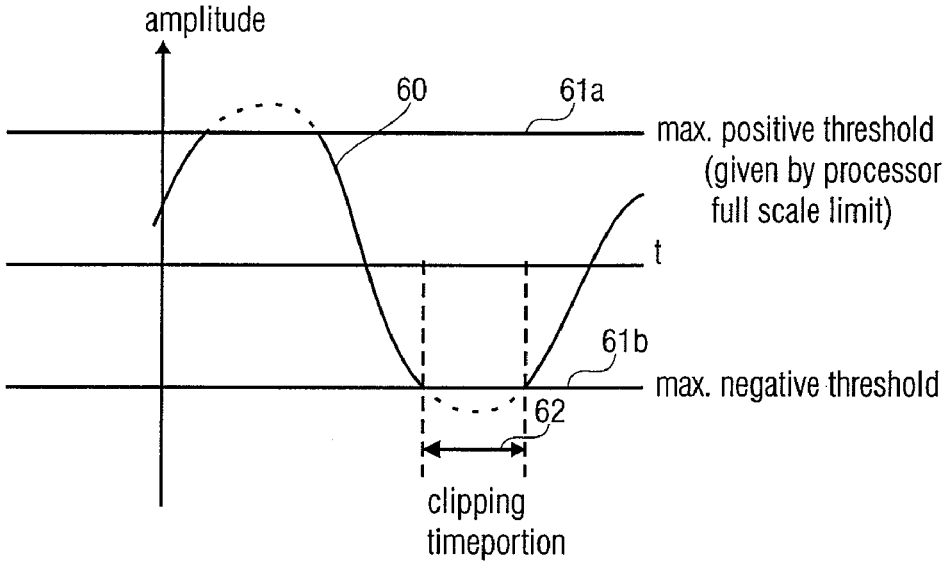
FIG. 6 an illustration of a clipped waveform.

FIG. 1 illustrates a preferred embodiment of an inventive apparatus for synthesizing three output channels using two input channels, wherein a second channel of the three output channels is intended for a speaker in an audio replay setup, which is positioned between two speakers, which are intended to receive the first output channel and the third output channel. The input channels are indicated by 10*a*, which channel can be for example the left channel L, and 10*b* for the second channel, which can be the right channel R. The output channels are indicated as 12*a* for the right channel, 12*b* for center channel and 12*c* for the left channel. Additional output channels can be generated such as a left surround output channel 14*a*, a right surround output channel 14*b* and a low frequency enhancement channel 14*c*. The arrangement of the corresponding speakers for these channels is shown in FIG. 5. In the middle of these speakers 12*a*, 12*b*, 12*c*, 14*a*, 14*b* is a sweet spot 50. When a listener is positioned within the sweet spot, then he or she will have an optimum sound impression.

Additionally, one might add a center surround channel 51 $C_s$, which is positioned between the left surround channel 14*a* and the right surround channel 14*b*. The signal for the center surround channel 51 can be calculated using the same process as calculating the signal for the center channel 12*b*. Additionally, the inventive methods can, therefore, also be applied to the calculation of the center surround channel in order to avoid clipping in the center surround channel.

It is to be noted that the inventive process is usable for each audio channel constellation, in which two input channels intended for two different spatial positions in a replay setup are used and in which three output channels are generated using these two input channels, wherein the second channel of the three channels is located between two additional speakers in the replay setup, which are provided with the first and the third input channel signals.

The inventive synthesizer apparatus of FIG. 1 includes an input channel analyzer 15 for analyzing the two input channels in order to determine signal components which occur in both input channels. These signal components which occur in both input channels can be used to build the real center channel, i.e. can be rendered via the center channel C shown in FIG. 5. Typically, a stereo signal includes a lot of such monophonic signal components such as a speaker person or, when music signals are considered, a singer or a solo instrument positioned in front of an orchestra and, therefore, positioned in front of the audience.

The inventive synthesizer apparatus additionally includes a time and frequency selective and, furthermore signal dependent signal generator 16 for generating the three output channels 12*a*, 12*b*, 12*c* using the two input channels 10*a*, 10*b* and information on detected signal components occurring in both input channels as provided via line 13. Particularly, the inventive signal generator is operative to feed detected signal components at least partly into the second channel. Furthermore, the generator is operative to only feed a portion of the detected signal components in the second channel, when there exists a situation, in which a complete feeding of the detected signal components would result in exceeding the maximum threshold.

Thus, the second output channel has a time portion, which only includes a part of the detected signal components to avoid clipping, while in a different portion of the second output channel, the complete detected signal components have been fed into the second output channel. The remainder of the detected signal components are included in the first and third output channels and, therefore, form the "phantom center" when these channels are rendered via the speaker setup for example shown in FIG. 5.

Depending on the implementation of the inventive concept, the "portion" of the detected signal components located in the second channel, and the remainder of the detected signal components located in the first and third channels can be an energy portion or frequency portion or any other portion, so that the second channel only includes a portion of the detected signal components and will not have any value above the maximum threshold and will, therefore, not induce any clipping distortions.

Figure 2A:
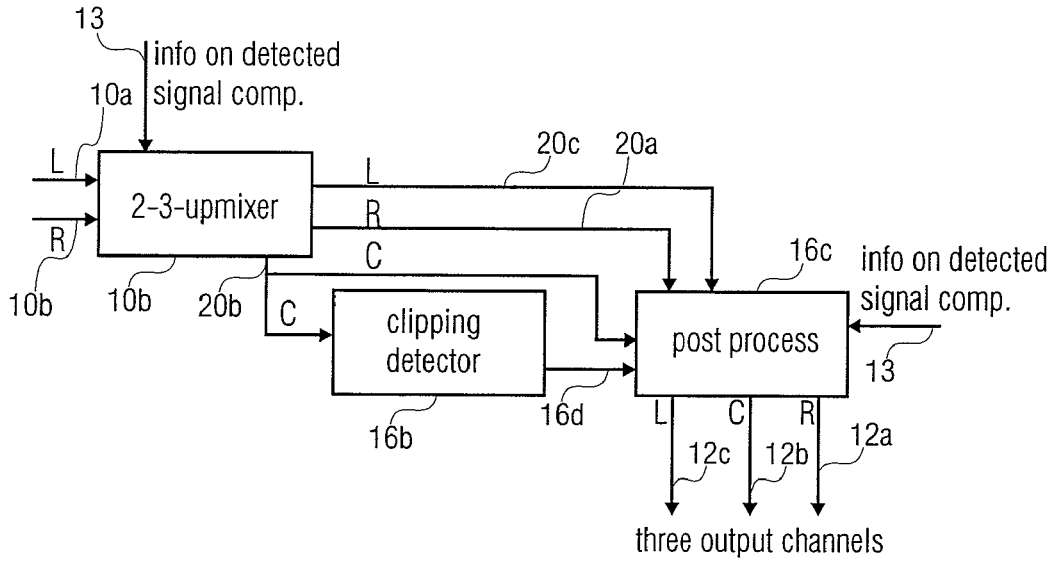
FIG. 2*a* a preferred embodiment of the signal generator of FIG. 1 having a post processor.

FIG. 2*a* illustrates a preferred embodiment of the inventive signal analyzer 16 of FIG. 1. Particularly, in the FIG. 2*a* embodiment, the signal analyzer includes a 2-3-upmixer 16 performing an upmixing process controlled by the input channels analyzer 15 of FIG. 1. The output of the 2-3-upmixer L, R, C are upmixed channels. However, channel C might be subject to clipping, since channel C is generated using an adding process, in which signal components from the left channel and from the right channel are added together.

The center channel C is input into a clipping detector 16*d*, which feeds a post processor 16*c*, which also receives information on detected signal components. Particularly, the clipping detector 16*b* is operative to examine the time wave form of the center channel 12*c*.

Depending on the implementation, the clipping detector can be constructed in different ways. When it is assumed that the FIG. 2*a* signal generator can process numbers having a magnitude being higher than a predetermined maximum threshold, then the clipping detector 16*b* simply examines the time waveform to see, whether there are higher numbers than the maximum threshold of the subsequent processing stage. When such a situation is detected, the post processor 16*c* is activated via activation line 16*d* to start post processing such that the energy of the center channel is reduced and the energy of the left and right channels is increased so that the three output channels 12*a*, 12*b*, 12*c* are finally output by the post processor 16*c*. Thus, in accordance with the FIG. 2*a* embodiment, the LR to LCR conversion process is done as usual. The internal first-stage center channel signal 20*b* is analyzed to check, whether clipping would occur if it has to be output as an external signal such as in an AES/EBU or as SPDIF format. When this happens, a part of the signal 20*b* is removed in the post processor 16*c* resulting in a modified center channel signal 12*b* and distributed instead to the intermediate left and right channels 20*a*, 20*c* as a "phantom center" contribution. After the postprocessing, the center channel signal 12*b* is again below 0 dBFS.

Figure 2B:
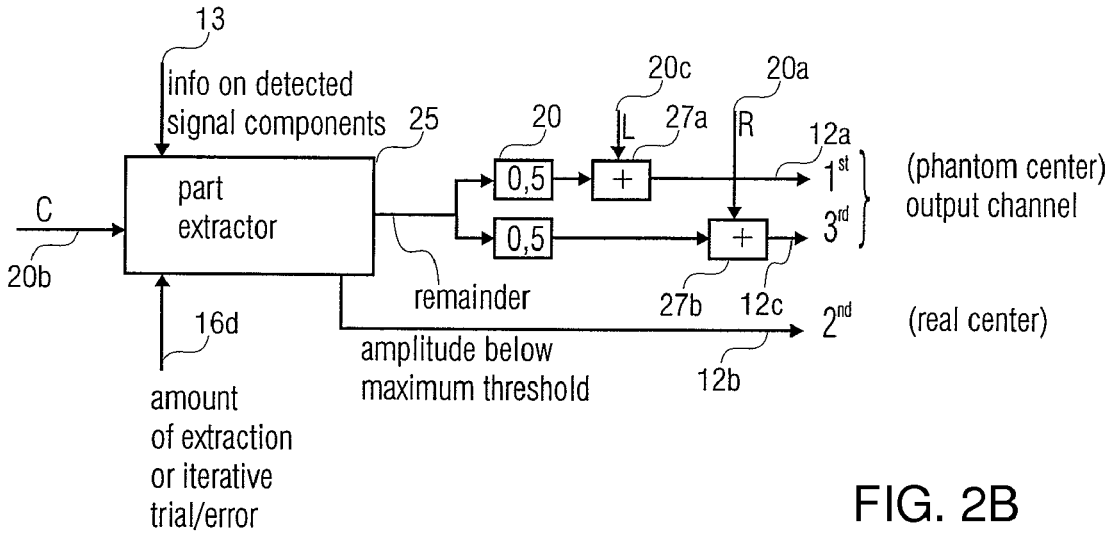
FIG. 2*b* a preferred implementation of the post processor of FIG. 2*a;*

A preferred embodiment of the post processor 16*c* is shown in FIG. 2*b*. The center channel 20*b* after the upmixer 16*a* is input into a part extractor 25. The part extractor receives information 13 on detected signal components and a control signal via line 16*d* from the clipping detector, which may also include an indication of an amount of extraction. Alternatively, the amount of extraction per iteration step may be fixed independent of any occurring clipping, and an iterative trial/error process can be applied to extract increasing amounts of the detected signal components in a step-by-step fashion until the clipping detector 16*b* does not detect any clipping anymore. Then, the modified center channel 12*b* is output by the part extractor, and the remainder of the detected signal components corresponding to the extracted part have to be redistributed to the left and right channels 20*c*, 20*a* output by the upmixer after multiplying by 0.5. To this end, the post processor includes two multipliers 26 in each branch or a single multiplier before branching, and a left adder 27*a* and a right adder 27*b*.

When the detection of the signal components occurring in both input channels has been perfect, then the left and right channels 20*a*, 20*c* do not include any "phantom center". However, by adding the extracted components (after multiplication by 0.5) to these channels, a phantom center is added to the left and right channels.

Subsequently, a further embodiment of the present invention and, particularly, of the signal generator 16 of FIG. 1 is discussed in connection with FIG. 3. The input channels are input into a controllable 2-3-upmixer receiving information on detected signal components for generating three output channels in a first iteration step controlled by an iteration controller 30. The first step will be equal to the upmixer operation in FIG. 2*a*, i.e., the center channel 20*b* can have clipping problems. Such a clipping situation will be detected by a clipping detector 16*b*. In contrast to the FIG. 2*a* embodiment, the clipping detector 16*b* controls the upmixer 16*a* in a feed-back way via the upmixer control line 31 to change the upmixing rule in a certain way so that the generated center channel 20*b* receives, after one or more iteration steps as controlled by the iteration controller 30, only an allowed portion of the detected signal components so that no clipping occurs anymore.

Figure 3:
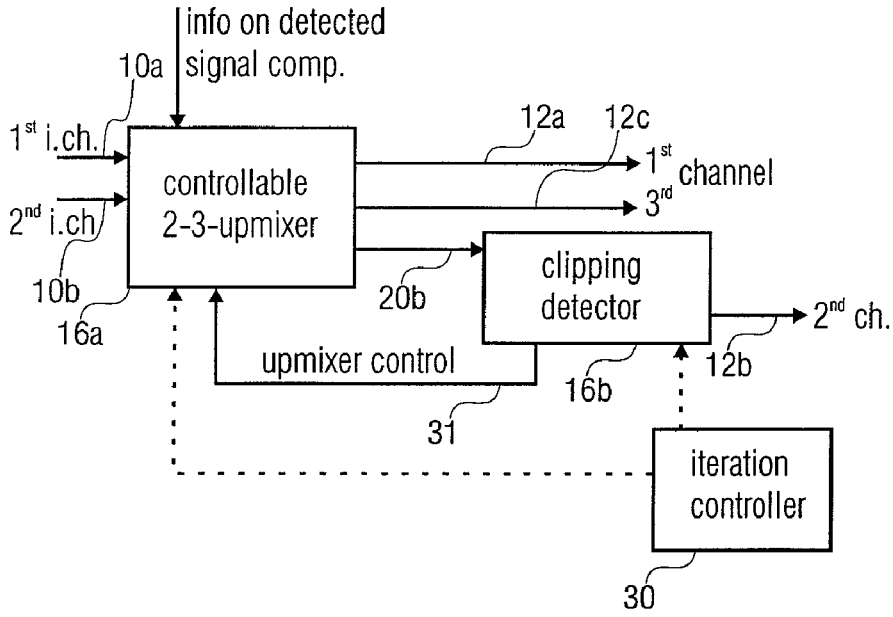
FIG. 3 a further embodiment of the inventive signal generator having an iterative upmixer control.

Thus, the FIG. 3 embodiment illustrates an iterative process. In a first pass of the iterative process, the up-mixer operation is done as usual. At the output, a detector 16*b* checks, whether clipping occurs. When clipping is detected, this time frame is processed again, now using the re-mapping process and using re-routing of a part of the center signal energy to the left and right channels as a phantom center contribution.

Figure 4:
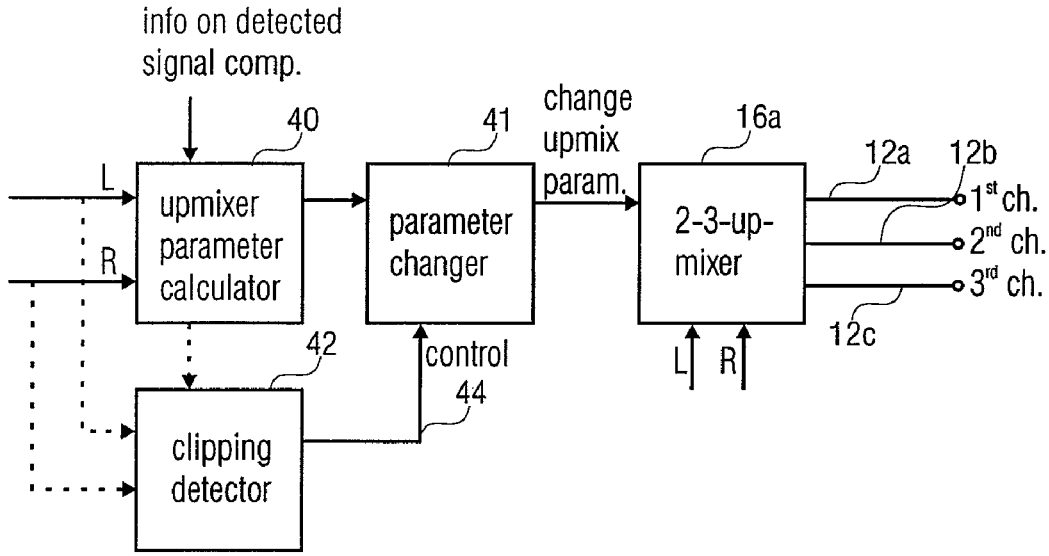
FIG. 4 a further embodiment of the inventive signal generator completely operating in the parameter domain.

The FIG. 4 embodiment completely operates in the parameter domain. To this end, an up-mixer parameter calculator 40 is provided, which is connected to a parameter changer 41. Additionally, a clipping detector 42 is provided, which is operative to examine the original left and right channels or the calculated up-mixer parameters to find out, whether clipping will occur or not after a straight forward up-mix process. When the clipping detector 42 detects a clipping danger, it controls a parameter change 41 via a control line 44 to provide changed up-mix parameters, which are then provided to a straight-forward up-mixer 16*a*, which then generates the first, second, and third output channels so that no clipping occurs in the second channel and, for a time frame, in which the clipping detector 42 has originally detected a clipping problem, the left and right channels 12*c*, 12*a*, have a phantom center contribution.

In contrast to the FIG. 2 and FIG. 3 embodiments, the inventive process is carried out based on processing parameters that are used for deriving the output signals 20*a*, 20*b*, 20*c*, or 12*a*, 12*b*, 12*c* from the input stereo signals. Thus, in order to provide implementations with still lower computational complexity, also the clipping detection and the manipulation of signal levels or part of it are based on the processing parameters. This is in contrast to the FIGS. 2 and 3 embodiments, in which the inventive process is carried out on actual audio channel signals that were already created for the center channel after a possible clipping could be detected.

The inventive clipping detection/control can be performed by a post-processing. Thus, the intended conversion parameters are analyzed and modified according to the inventive concept to provide clipping after the synthesis of the actual output audio signals. An alternative way to control the parameter change 41 is via an iterative way. Intended conversion parameters are analyzed. When, after the synthesis of the real audio signal, clipping may occur, the conversion parameters are modified. Then, the process is again started and finally, the output channel signals are synthesized without any clipping and with real center and phantom center contributions in the corresponding channels.

Subsequently, a preferred implementation of the input channels analyzer will be discussed. To this end, reference is made to FIG. 8, which illustrates such a preferred input channels analyzer 15. First of all, subsequent or overlapping frames following each other are generated using a windowing block 80 so that, at the output of block 80, there is, on line 81*a*, a block of values of the left channel and, on line 81*b*, a block of values of the right channel. Then, a frequency analysis is performed for each block individually. To this end, a frequency analyzer 82 is provided for each channel.

The frequency analyzer can be any device for generating a frequency domain representation of a time domain signal. Such a frequency analyzer can include a short-time Fourier transform, an FFT algorithm, or an MDCT transform or any other transform device. Alternatively, the frequency analyzer block 82 may also include a subband filter bank for generating for example 32 subband channels or a higher or lower number of subband channels from a block of input signal values. Depending on the implementation of the subband filter bank, the functionality of the framing device 80 and the frequency analysis block 82 can be implemented in a single digitally implemented subband filter bank.

Then, a band-wise cross correlation is performed as indicated by device 84. Thus, the cross-correlator determines a cross correlation measure between corresponding bands, i.e., bands having the same frequency index. The cross correlation measure determined by block 84 can have a value between 0 and 1, wherein 0 indicates no correlation, and wherein 1 indicates full correlation. When the device 84 outputs a low cross correlation measure, this means that the left and right signal components in the respective band are different from each other so that this band does not include signal components occurring in both bands, which should be inserted into a center channel. When, however, the cross correlation measure is high, indicating that the signals in both bands are very similar to each other, then this band has a signal component occurring in the left and right channels so that this band should be inserted into the center channel.

A further criterion for deciding whether signals in bands are similar to each other is the signal energy. Therefore, the preferred embodiment of the inventive input channels analyzer includes a band-wise energy calculator 85, which calculates the energy in each band and which outputs an energy similarity measure indicating, whether the energies in the corresponding bands are similar to each other or different from each other.

The energy similarity measure output by device 85 and the cross correlation measure output by device 84 are both input into a final decision stage 86, which comes to a conclusion that, in a certain frame, a certain band i occurs in both channels or not. When the decision stage 86 determines that the signal occurs in both channels, then this signal portion is fed into the center channel to generate a "real center".

Figure 8:
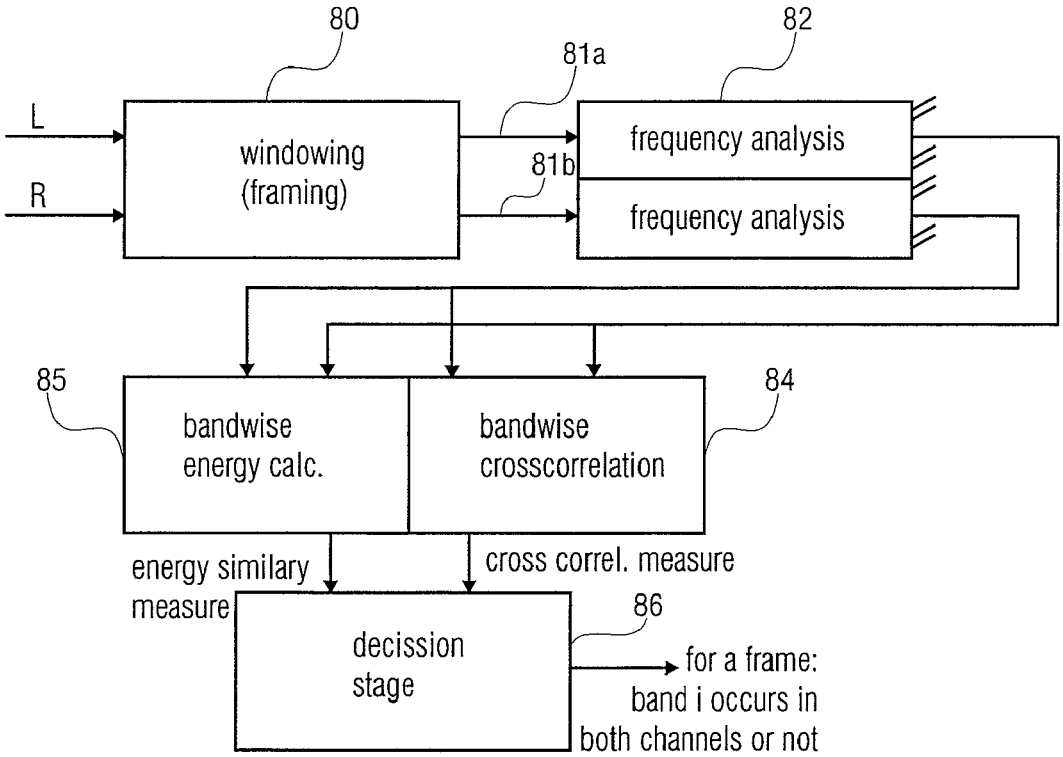
FIG. 8 illustrates a preferred input channels analyzer.

FIG. 8 shows an embodiment for implementing the input channels analyzer. Additional embodiments are known in the art and, for example, illustrated in "Spatial enhancement of audio recordings", Jot and Avendano, 23$^{rd}$ International AES Conference, Copenhagen, Denmark, May 23-25, 2003. Particularly, other methods of analyzing two channels to find signal components in these channels include statistical or analytical analyzing methods such as the principle component analysis or the independent subspace analysis or other methods known in the art of audio analysis. All these methods have in common that they detect signal components occurring in both channels, which should be fed into a center channel to generate a real center.

Figure 7:
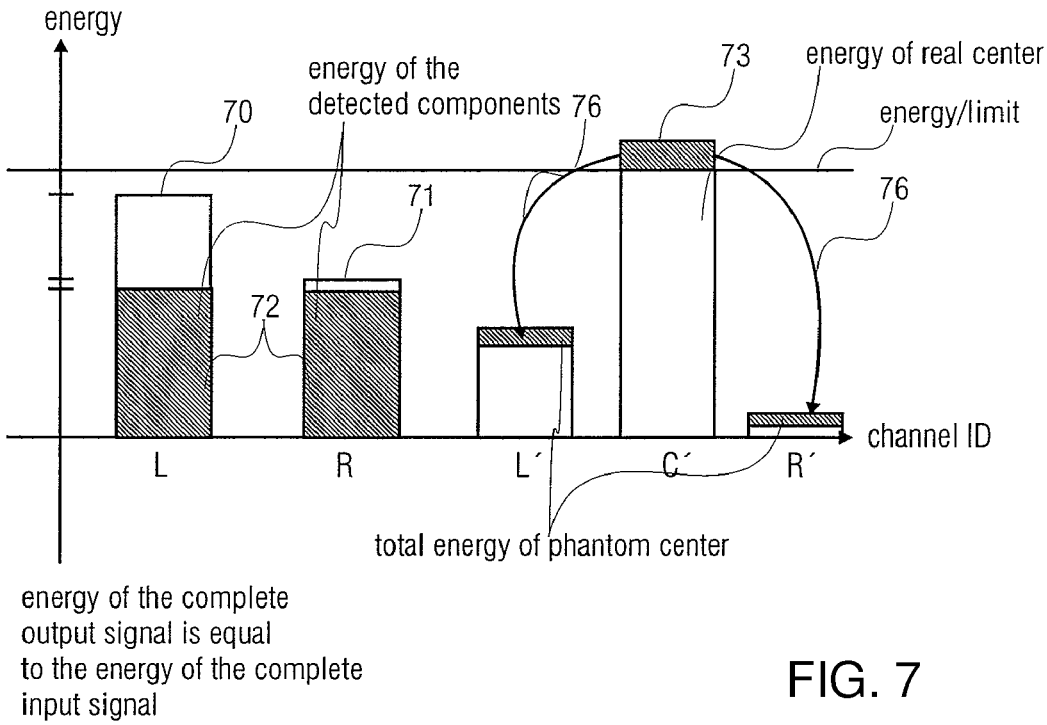
FIG. 7 a schematic illustration of the energy situation of the original two-channel input signal and the three-channel output signal before and after clipping.

Subsequently, reference is made to FIG. 7 to illustrate an energy situation before and after a two-three upmix process has been implemented by the two-three upmixer 16*a* in the Figures. A left input channel L illustrated at 70 in FIG. 7 has a certain energy. In this example, the right input channel of the two stereo input channels has a different (lower) energy as illustrated at 71. It is assumed that the channel analyzer has found out that there are signal components occurring in both channels. These signal components occurring in both channels have an energy as illustrated at 72 in FIG. 7. When the whole energy 72 would be fed into the center channel as shown at 73, the energy of the center channel would be above an energy limit, wherein the energy limit at least roughly illustrates that the signal having such a high energy has amplitude values above the amplitude maximum threshold. Therefore, only a portion of the energy 72 is input into the real center, while the exceeding portion is equally (re-) distributed to the synthesized left and right channels L' and R' as illustrated by arrows 76.

In this context, it is to be noted that there are different ways of redistributing energy from the center channel back to the left and right channels or for introducing a correct amount of energy from an original left channel and an original right channel into the center channel. One could, for example, scale down all detected signal components by a certain downscaling factor and introduce the downscaled signal into the center channel. This would have equal consequences for the signal components in each band, when a frequency-selective analysis was applied. Alternatively, one could also perform a band-wise energy control. This means that when there have been detected e.g. 10 bands having detected signal components, one could introduce only 5 bands into the center channel and leave the remaining 5 bands in the left and right channels in order to reduce the energy in the center channel.

Depending on certain implementation requirements of the inventive methods, the inventive method can be implemented in hardware or in software. The implementation can be performed using a digital storage medium, in particular a disk or a CD having electronically readable control signals stored thereon, which can cooperate with a programmable computer system such that the inventive method is performed. Generally, the present invention is, therefore, a computer program product with a program code stored on a machine-readable carrier, the program code being configured for performing the inventive method, when the computer program product runs on a computer. In other words, the invention is also a computer program having a program code for performing the inventive method, when the computer program runs on a computer.

Those skilled in the art can now appreciate from the foregoing description that the broad teachings of the present invention can be implemented in a variety of forms. Therefore, while this information has been described in connection with a particular example thereof, the true scope of the invention should not be so limited, since other modifications will become apparent to the skilled practitioner upon a study of the drawings, specification and the claims.

The invention claimed is:

1. Apparatus for synthesizing three output channels using two input channels, wherein a second channel of the three output channels is feedable to a speaker in an intended audio rendering scheme, which is positioned between two speakers being feedable with the first output channel and the third output channel, comprising:

an analyzer for analyzing the two input channels for detecting signal components occurring in both input channels; and a signal generator for generating the three output channels using the two input channels, wherein the signal generator is operative:

to feed detected signal components at least partly into the second channel, and to only feed a part of the detected signal components into the second channel, when a complete feeding of the detected signal components would result in exceeding a maximum threshold for the second channel, wherein the signal generator comprises;

a two-three up-mixer for generating three intermediate channels, wherein the second channel includes the detected signal components;

a clipping detector for detecting a portion of the second channel having an amplitude above the maximum threshold; and a post processor for removing a portion of the detected signal components from the second channel in a portion detected by the clipping detector and for adding a signal corresponding to the removed portion to the first channel and to the third channel.

2. Apparatus in accordance with claim 1, in which the signal generator comprises:

a clipping detector for determining a portion of the input channels, in which there is a clipping probability;

a two-three up-mixer for generating three intermediate channels, wherein a second intermediate channel includes at least a portion of the detected signal components; and a controller for controlling the two-three upmixer so that a generation parameter for up-mixing the portion determined by the clipping detector is controlled such that the second channel always has an amplitude below or equal to the maximum threshold.

3. Apparatus in accordance with claim 1, in which the signal generator is operative to generate the three output channels such that, for a certain time period, a total energy of the three output channels and potentially generated additional output channels is equal to an electrical or acoustical energy of the two input channels.

4. Apparatus in accordance with claim 1, in which the signal generator is operative to generate the second output channel such that the portion of the detected signal components fed into the second channel is as large as possible so that an energy of the second output channel, which includes only the portion of the detected signal components always has a maximum amplitude below or equal to the maximum threshold.

5. Apparatus in accordance with claim 1, in which the signal generator is adapted so that a remainder of the detected signal components, which is not in the second channel, is included in the first and the third channels.

6. Apparatus in accordance with claim 1, in which the maximum threshold is a full-scale amplitude determined by the apparatus for synthesizing or a digital or an analog processing device connected to the apparatus for synthesizing.

7. Apparatus in accordance with claim 6, in which the maximum threshold is equal to a maximum allowable positive or negative sampling value of a time domain waveform of a signal.

8. Apparatus in accordance with claim 1, in which the analyzer is operative to determine a measure for a cross-correlation between at least a portion of the first input channel and the second input channel and to detect a portion having a cross-correlation measure above a similarity threshold.

9. Apparatus in accordance with claim 8, in which the analyzer is operative to detect an energy of a portion of the first channel and a portion of the second channel and to detect portions of the channels having energies being equal or differing by less than an equality threshold.

10. Apparatus in accordance with claim 1, in which the analyzer and the signal generator are operative to perform a frequency selective or time selective analysis and synthesis.

11. Apparatus in accordance with claim 1, in which the first and the second channels are a left channel and a right channel of a stereo representation of an audio signal, and in which the three output channels are a front-left channel, a center channel, and a front-right channel, or a rear-left channel, a rear-center channel, and a rear-right channel.

12. Method of synthesizing three output channels using two input channels, wherein a second channel of the three output channels is feedable to a speaker in an intended audio rendering scheme, which is positioned between two speakers being feedable with the first output channel and the third output channel, comprising:

analyzing the two input channels for detecting signal components occurring in both input channels; and generating the three output channels using the two input channels, wherein the step of generating is operative:

to feed detected signal components at least partly into the second channel, and to only feed a part of the detected signal components into the second channel, when a complete feeding of the detected signal components would result in exceeding a maximum threshold for the second channel, wherein the step of generating comprises generating three intermediate channels, wherein the second channel includes the detected signal components;

detecting a portion of the second channel having an amplitude above the maximum threshold; and removing a portion of the detected signal components from the second channel in a detected portion and adding a signal corresponding to the removed portion to the first channel and to the third channel.

13. Machine-readable storage medium having stored thereon a computer program for performing, when running on a computer, a method of synthesizing three output channels using two input channels, wherein a second channel of the three output channels is feedable to a speaker in an intended audio rendering scheme, which is positioned between two speakers being feedable with the first output channel and the third output channel, comprising: analyzing the two input channels for detecting signal components occurring in both input channels; and generating the three output channels using the two input channels, wherein the step of generating is operative to feed detected signal components at least partly into the second channel, and to only feed a part of the detected signal components into the second channel, when a complete feeding of the detected signal components would result in exceeding a maximum threshold for the second channel, wherein the step of generating comprises generating three intermediate channels, wherein the second channel includes the detected signal components; detecting a portion of the second channel having an amplitude above the maximum threshold; and removing a portion of the detected signal components from the second channel in a detected portion and adding a signal corresponding to the removed portion to the first channel and to the third channel.

14. Apparatus for synthesizing three output channels using two input channels, wherein a second channel of the three output channels is feedable to a speaker in an intended audio rendering scheme, which is positioned between two speakers being feedable with the first output channel and the third output channel, comprising:

an analyzer for analyzing the two input channels for detecting signal components occurring in both input channels; and a signal generator for generating the three output channels using the two input channels, wherein the signal generator is operative:

to feed detected signal components at least partly into the second channel, and to only feed a part of the detected signal components into the second channel, when a complete feeding of the detected signal components would result in exceeding a maximum threshold for the second channel, wherein the signal generator comprises:

a two-three up-mixer for generating at least a second intermediate channel including at least a portion of the detected signal components;

a clipping detector for detecting a portion of the second channel having an amplitude above the maximum threshold; and a two-three up-mixer control for controlling the generation of the three output channels so that only a portion of the detected signal components is fed to the second channel and a remainder of the signal components remains positioned in the first and the third output channels.

15. Apparatus for synthesizing three output channels using two input channels, wherein a second channel of the three output channels is feedable to a speaker in an intended audio rendering scheme, which is positioned between two speakers being feedable with the first output channel and the third output channel, comprising:

an analyzer for analyzing the two input channels for detecting signal components occurring in both input channels; and a signal generator for generating the three output channels using the two input channels, wherein the signal generator is operative:

to feed detected signal components at least partly into the second channel, and to only feed a part of the detected signal components into the second channel, when a complete feeding of the detected signal components would result in exceeding a maximum threshold for the second channel, wherein the signal generator comprises:

a clipping detector for determining a portion of the input channels, in which there is a clipping probability;

a two-three up-mixer for generating three intermediate channels, wherein a second intermediate channel includes at least a portion of the detected signal components; and a controller for controlling the two-three upmixer so that a generation parameter for up-mixing the portion determined by the clipping detector is controlled such that the second channel always has an amplitude below or equal to the maximum threshold.

16. Method of synthesizing three output channels using two input channels, wherein a second channel of the three output channels is feedable to a speaker in an intended audio rendering scheme, which is positioned between two speakers being feedable with the first output channel and the third output channel, comprising:

analyzing the two input channels for detecting signal components occurring in both input channels; and generating the three output channels using the two input channels, wherein the step of generating is operative:

to feed detected signal components at least partly into the second channel, and to only feed a part of the detected signal components into the second channel, when a complete feeding of the detected signal components would result in exceeding a maximum threshold for the second channel, wherein the step of generating comprises generating at least a second intermediate channel including at least a portion of the detected signal components;

detecting a portion of the second channel having an amplitude above the maximum threshold; and controlling the generation of the three output channels so that only a portion of the detected signal components is fed to the second channel and a remainder of the signal components remains positioned in the first and the third output channels.

17. Method of synthesizing three output channels using two input channels, wherein a second channel of the three output channels is feedable to a speaker in an intended audio rendering scheme, which is positioned between two speakers being feedable with the first output channel and the third output channel, comprising:

analyzing the two input channels for detecting signal components occurring in both input channels; and generating the three output channels using the two input channels, wherein the step of generating is operative:

to feed detected signal components at least partly into the second channel, and to only feed a part of the detected signal components into the second channel, when a complete feeding of the detected signal components would result in exceeding a maximum threshold for the second channel, wherein the step of generating comprises determining a portion of the input channels, in which there is a clipping probability;

generating three intermediate channels, wherein a second intermediate channel includes at least a portion of the detected signal components; and controlling the step of generating so that a generation parameter for up-mixing the detected portion is controlled such that the second channel always has an amplitude below or equal to the maximum threshold.

18. Machine-readable storage medium having stored thereon a computer program for performing, when running on a computer, a method of synthesizing three output channels using two input channels, wherein a second channel of the three output channels is feedable to a speaker in an intended audio rendering scheme, which is positioned between two speakers being feedable with the first output channel and the third output channel, comprising: analyzing the two input channels for detecting signal components occurring in both input channels; and generating the three output channels using the two input channels, wherein the step of generating is operative to feed detected signal components at least partly into the second channel, and to only feed a part of the detected signal components into the second channel, when a complete feeding of the detected signal components would result in exceeding a maximum threshold for the second channel wherein the step of generating comprises generating at least a second intermediate channel including at least a portion of the detected signal components; detecting a portion of the second channel having an amplitude above the maximum threshold; and controlling the generation of the three output channels so that only a portion of the detected signal components is fed to the second channel and a remainder of the signal components remains positioned in the first and the third output channels.

19. Machine-readable storage medium having stored thereon a computer program for performing, when running on a computer, a method of synthesizing three output channels using two input channels, wherein a second channel of the three output channels is feedable to a speaker in an intended audio rendering scheme, which is positioned between two speakers being feedable with the first output channel and the third output channel, comprising: analyzing the two input channels for detecting signal components occurring in both input channels; and generating the three output channels using the two input channels, wherein the step of generating is operative to feed detected signal components at least partly into the second channel, and to only feed a part of the detected signal components into the second channel, when a complete feeding of the detected signal components would result in exceeding a maximum threshold for the second channel wherein the step of generating comprises determining a portion of the input channels, in which there is a clipping probability; generating three intermediate channels, wherein a second intermediate channel includes at least a portion of the detected signal components; and controlling the step of generating so that a generation parameter for up-mixing the detected portion is controlled such that the second channel always has an amplitude below or equal to the maximum threshold.

* * * * *